US005329083A

United States Patent [19]

Lai

[11] Patent Number: 5,329,083

[45] Date of Patent: Jul. 12, 1994

[54] ON-LINE SWITCH HAVING WATER-PROOF PROTECTION

[76] Inventor: Shih-Wang Lai, P.O. Box 55-1670, Teipei, Taiwan

[21] Appl. No.: 983,382

[22] Filed: Nov. 30, 1992

[51] Int. Cl.[5] ..... H01H 13/06

[52] U.S. Cl. ..... 200/302.2; 200/303

[58] Field of Search ..... 200/505, 293, 302.1, 200/302.2, 303, 302.3, 304, 333, 345, 332.2, 293.1

[56] References Cited

U.S. PATENT DOCUMENTS

| | | | |
|---|---|---|---|
| 2,467,820 | 4/1949 | Gaynor | 200/303 |
| 2,740,024 | 3/1956 | Rogers | 200/302.2 |
| 2,773,944 | 12/1956 | Haydon et al. | 200/302.1 X |
| 3,242,273 | 3/1966 | Van Der Put | 200/303 X |
| 3,541,488 | 11/1970 | Odson | 200/302.1 X |
| 4,317,015 | 2/1982 | Buttner et al. | 200/303 X |
| 4,766,272 | 8/1988 | Guzzon | 200/302.2 |
| 5,070,219 | 12/1991 | Grosskrueger et al. | 200/303 X |
| 5,072,213 | 12/1991 | Close | 200/341 X |

FOREIGN PATENT DOCUMENTS

| | | | |
|---|---|---|---|
| 2927752 | 2/1981 | Fed. Rep. of Germany | 200/303 |
| 3238850 | 4/1984 | Fed. Rep. of Germany | 200/303 |
| 183259 | 4/1963 | Sweden | 200/293 |

*Primary Examiner*—Glenn J. Barrett

[57] ABSTRACT

An on-line switch includes a switch housing formed by combining an upper half shell on a lower half shell, a push-button switching device encased in the housing having a push button reciprocatively held in a button holder of the switching device and normally protruding upwardly outwardly beyond the housing for depressibly switching on or off of a power supply through the on-line switch connected between an input cord and an output cord of a power source, an electrically insulative protective cover integrally formed on an outer circumferential surface of the switch housing for completely shielding the switch housing for water proof and for protecting the cords from their damage, and a sealing cap formed as a telescopic bellows and made of electrically insulative elastomer material secured with the button holder of the push-button switching device for sealing the push button held in the switching device in the switch housing for water proof purpose, thereby providing an on-line switch of a power line suitable for use in a wet, rainy or moisture corrosive environment or weather.

3 Claims, 5 Drawing Sheets

ON-LINE SWITCH HAVING WATER-PROOF PROTECTION

BACKGROUND OF THE INVENTION

A conventional on-off switch provided on an electric cord as shown in FIGS. 1, 1*a* includes a slide switch slidably held in a switch housing for operatively connecting or disconnecting the contactors between input terminal T1 and output terminal T2 for on-off control of a power line, which however has the following drawbacks:

1. The slide switch S is transversely reciprocated in the switch housing, lacking of water-proof protection, thereby being unable to serve as an outdoor switch especially used in a wet environment or rainy weather.

2. When pulling the electric cord having a pulling force acting upon the two terminals T1, T2 of the switch, the wires of the electric cord at the terminals will be easily broken, damaged or loosened to influence the power supply through the switch.

The present inventor has found the drawbacks of the conventional on-line switch, and invented the present on-line switch having water-proof property.

SUMMARY OF THE INVENTION

The object of the present invention is to provide an on-line switch including a switch housing formed by combining an upper half shell on a lower half shell, a push-button switching device encased in the housing having a push button reciprocatively held in a button holder of the switching device and normally protruding upwardly outwardly beyond the housing for depressibly switching on or off of a power supply through the on-line switch connected between an input cord and an output cord of a power source, an electrically insulative protective cover integrally formed on an outer circumferential surface of the switch housing for completely shielding the switch housing for water proof and for protecting the cords from their damage, and a sealing cap formed as a telescopic bellows and made of electrically insulative elastomer material secured with the button holder of the push-button switching device for sealing the push button held in the switching device in the switch housing for water proof purpose, thereby providing an on-line switch of a power line suitable for use in a wet, rainy or moisture-corrosive environment or weather.

DETAILED DESCRIPTION

Figure 1:
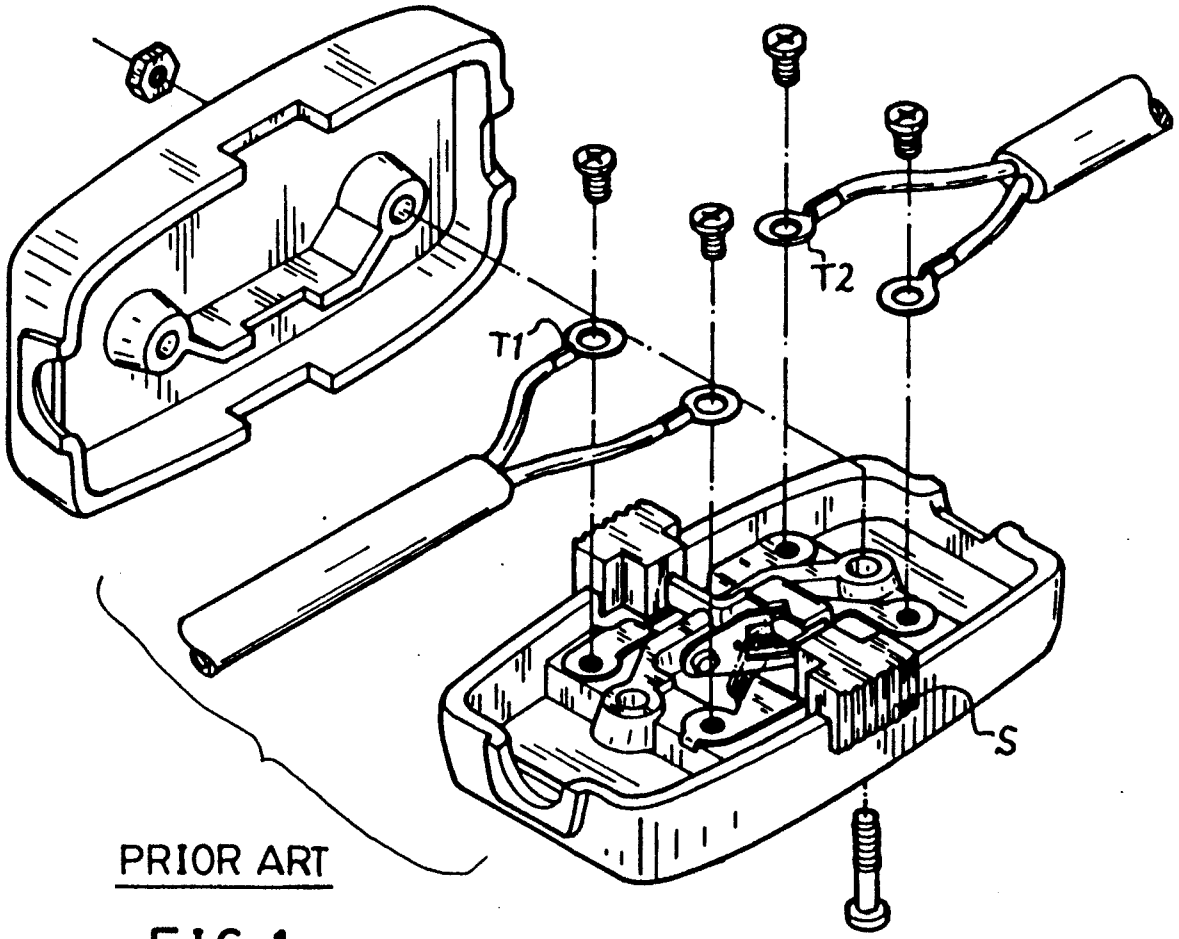
PRIOR ART FIG.1
FIG. 1 shows a prior art of a conventional on-line switch.
Figure 1A:
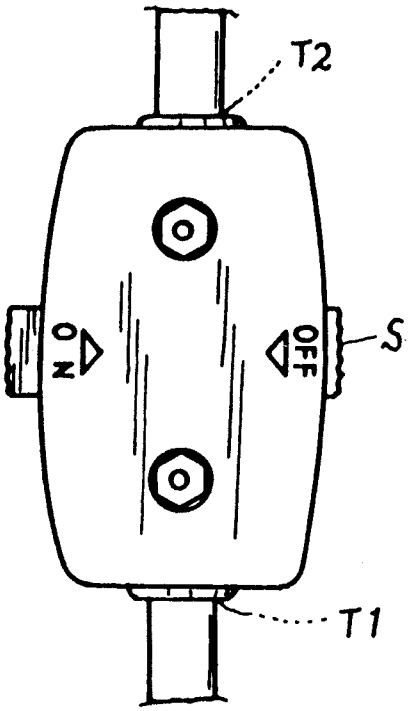
PRIOR ART FIG.1A
FIG. 1*a* is a plan view of the switch as shown in FIG. 1.
Figure 2:
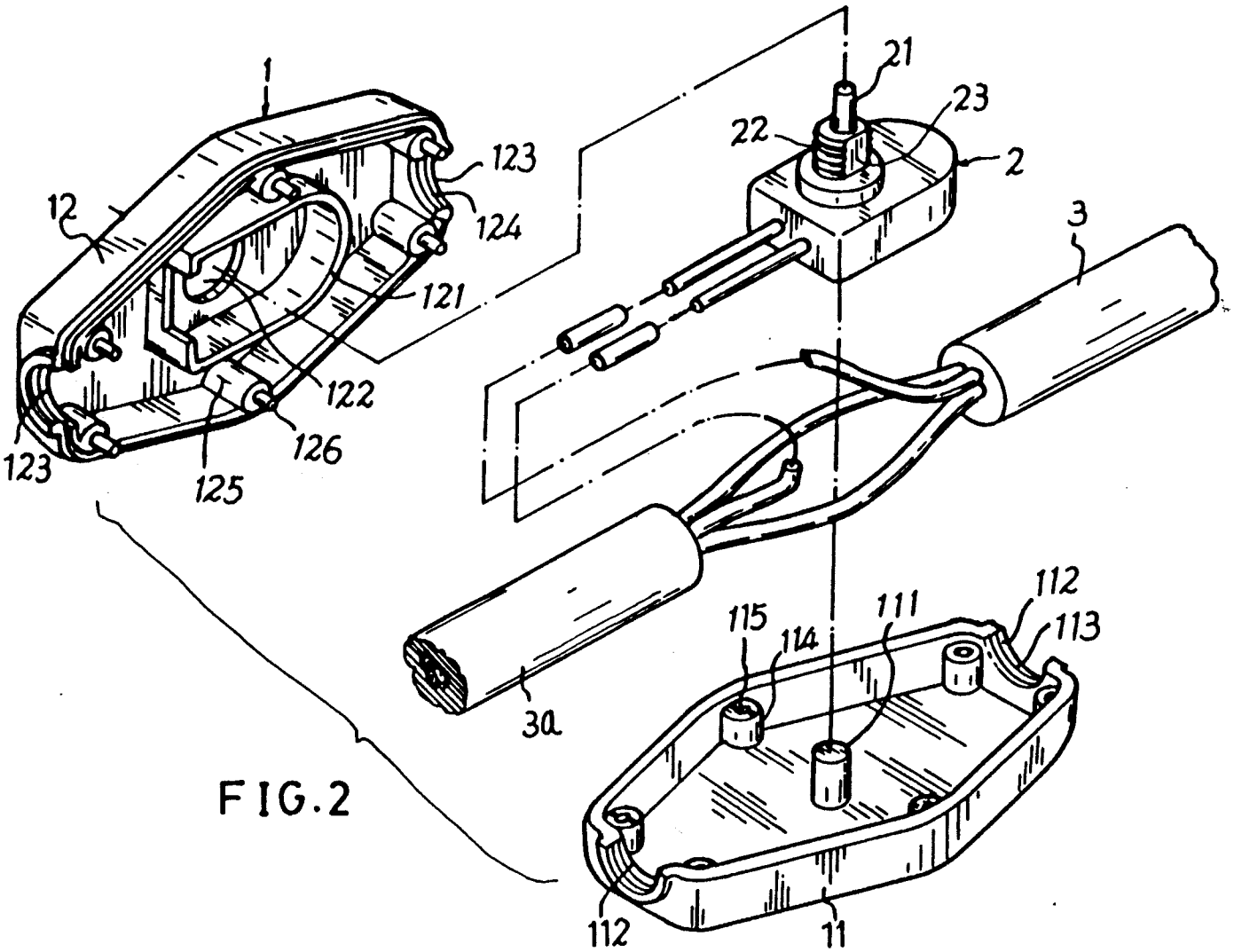
FIG. 2 is an exploded view of the present invention.
Figure 4:
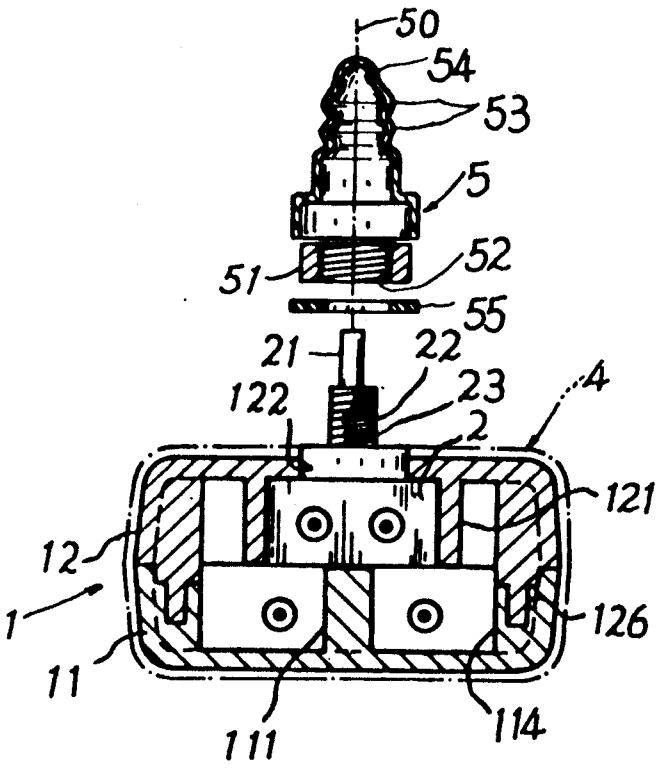
FIG. 4 is a sectional drawing of the present invention when viewed from 4—4 direction of FIG. 3.
Figure 3:
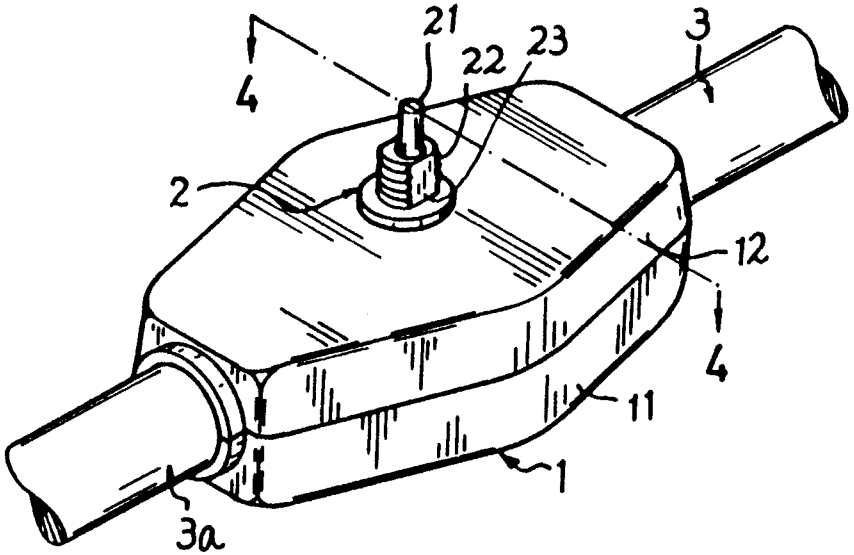
FIG. 3 is a perspective exploded view of the present invention.

As shown in FIGS. 2-6, the present invention comprises: a switch housing 1, a push-button switching means 2, an input cord 3 connected to a first end portion of the switching means 2 within the housing 1, an output cord 3*a* connected to a second end portion of the switching means 2 opposite to its first end portion, a protective cover 4 shielding the housing 1, and a sealing cap 5 sealing a push button of the switching means 2.

The switch housing 1 includes: a lower half shell 11 having a central protrusion 111 formed on a central portion of the lower half shell 11, two lower semi-holes 112 respectively formed in two opposite end portions of the lower shell 11 each lower semi-hole 112 having a plurality of corrugated teeth 113 formed therein, and a plurality of lower stems 114 each lower stem 114 having a pin hole 115 recessed in the lower stem 114; and an upper half shell 12 having a plurality of upper stems 125 each upper stem 125 having a pin 126 protruding downwardly and engageable with each pin hole 115 of each lower stem 114 for combining the upper half shell 12 with the lower half shell 11 for assembling the switch housing 1, a button socket 121 formed in the upper half shell 12 for embedding the push-button switching means 2 in the button socket 121, a button hole 122 formed in a central portion of the upper half shell 12 for protruding a push button 21 of the switching means 2 upwardly outwardly from the housing 1, and a pair of upper semi-holes 123 respectively formed in two opposite end portions of the upper shell 12 each upper semi-hole 123 having a plurality of corrugated teeth 124 formed therein, and combinable with the pair of lower semi-holes 112 for respectively clamping the input cord 3 and the output cord 3*a* in the semi-holes 112, 123 to be bitten by the corrugated teeth 113, 124 formed in the semi-holes 112, 123 for firmly securing the input and output cords 3, 3*a* with the switch housing 1.

The push-button switching means 2 includes: the push button 21 reciprocatively held in a button holder 22 retained on the central protrusion 111 of the lower shell 11 and engageably embedded in the button socket 121 in the housing 1 with the push button 21 normally protruding upwardly outwardly from the button hole 122 of the housing 1 to be operatively depressed for switching on or off of a power supply through the input cord 3 and the output cord 3*a* of a power source.

The protective cover 4 is made of electrically insulative material and is processed to cover an outer circumferential surface of the switch housing 1 for completely shielding the housing 1 and for shielding a base portion 23 of the button holder 22 except the button holder 22 protruding outwardly from the housing 1.

Figure 5:
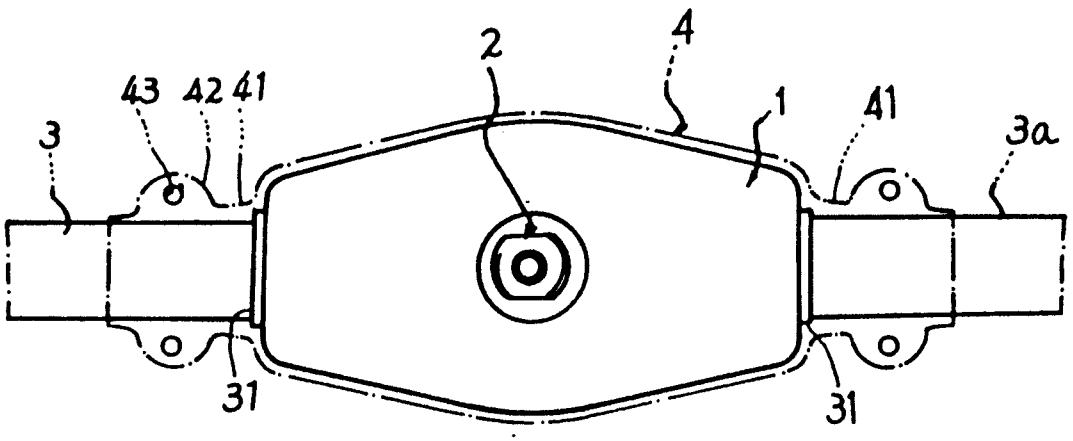
FIG. 5 is a plan view of the present invention.
Figure 6:
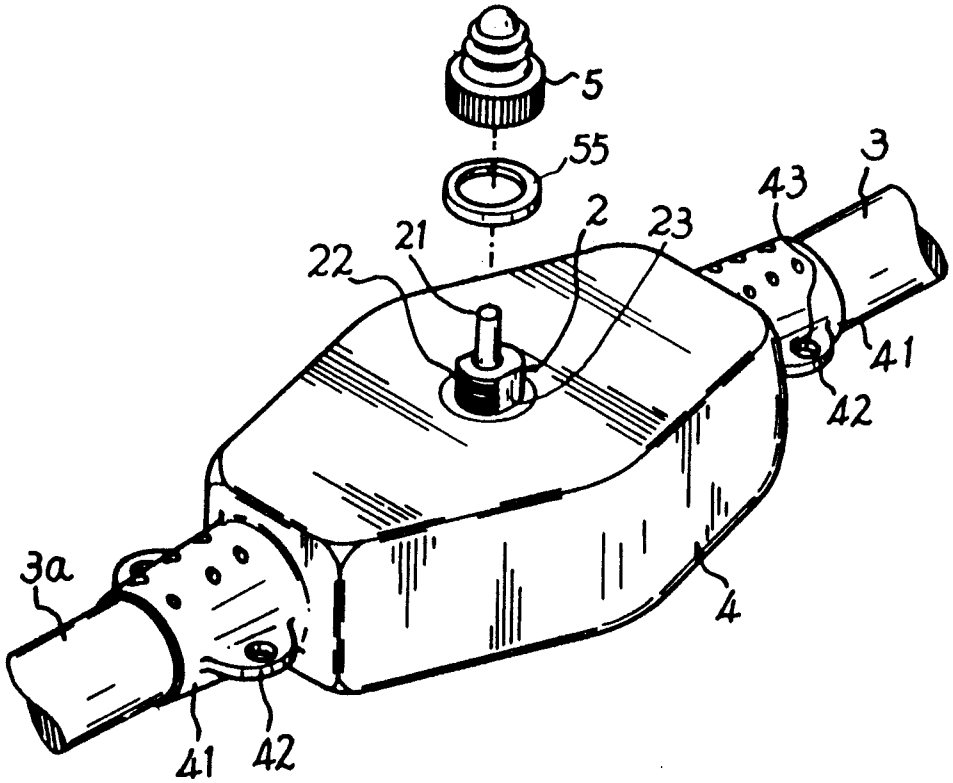
FIG. 6 is a perspective view of the present invention.

As shown in FIGS. 5, 6, the protective cover 4 includes two cord sheaths 41 each sheath 41 integrally formed with a joint portion 31 between either input cord 3 or output cord 3*a* with the housing 1 for well sealing the joint portions 31 on two opposite sides of the housing 1.

Each cord sheath 41 includes a lug 42 protruding sideways from the sheath and formed with a hanging hole 43 in the lug 42 for hanging purpose.

The sealing cap 5 is made of electrically insulative elastomer materials and includes: a sleeve member 51 having female threads 52 formed in the sleeve member 51 and engageable with male threads formed on the button holder 22 of the switching means 2, a bellows portion 53 having a plurality of corrugated concentric rings overlapping with one another and telescopically expandible and retractable about a longitudinal axis 50 of the cap 5, an upper cap portion 54 formed on a top portion of the bellows 53 for operatively depressing the push button 21 of the switching means 2 disposed within the cap 5, and a packing ring 55 packed between the cap 5 and the base portion 23 of the switching means 2 for sealably securing the cap 5 on the switching means 2.

Since the housing 1 and the joint portions 31 of the two cords 3, 3*a* are completely sealed by the insulative protective cover 4 and the push button switching means 2 is sealed by the cap 5 so that the switch of the present invention is completely sealed for water proof purpose, durable for uses is wet or moisture-attack environment or weather for ensuring electric and job safety for a safer outdoor or construction site power supply system.

The cap 5 is made as a bellows 53 having telescopic concentric rings for increasing the elastic force of the cap for a better restoring effect after depressing the cap 5 and the push button 21 disposed within the cap 5, and also for allowing a reciprocative stroke of the push button 21 during its on-off operations within the sealable telescopic elastic bellows 53, prolonging the service life of the cap 5 by decreasing its broken or wearing possibility after repeated reciprocative movements of the cap 5.

The cords 3, 3*a* are firmly connected in the housing 1 as bitten by the corrugated teeth 113, 124 formed in two opposite ends of the housing 1 and also integrally combined with the two sheaths 41 of the protective cover 4 so that each joint portion 31 between either cord 3 or 3*a* with the housing 1 is reinforced to prevent a loosening or disconnection of the cords from the switching means 2 and the housing 1. It means that upon an acting of a drawing or pulling force on the cords 3, 3*a* having a tendency to loosen the connection between the wires of the cords with the switching means 2 in the housing 1, the drawing or pulling force will be firstly counteracted or reduced by the sheaths 41 integrally forming on two joint portions 31 of the two cords 3, 3*a*, thereby being minimized without breaking or disconnecting the wires of the two cords from the push-button switching means 2 for a stronger and longer power supply service.

Other modifications of the on-line switches can be made from the present invention within the spirit and scope as claimed in this invention, which are not limited in this invention.

I claim:

1. An on-line switch comprising: a switch housing, a push-button switching means encased in the housing adapted for depressibly switching on or off a power supply which extends through said switching means, said switching means being adapted to be connected between an input cord and an output cord of a power source, a protective cover shielding an outer circumferential surface of the switch housing for waterproofing the switch housing and being adapted for protecting the cords connected to the switching means, and a sealing cap formed as a telescopic bellows secured with the push-button switching means for sealing a push button held in the switching means in the switch housing for waterproofing the switch; said switch housing including: a lower half shell having a central protrusion formed on a central portion of the lower half shell, two lower semi-holes respectively formed in two opposite end portions of the lower shell, each lower semi-hole having a plurality of corrugated teeth formed therein, and a plurality of lower stems, each lower stem having a pin hole recessed in the lower stem; and an upper half shell having a plurality of upper stems each upper stem having a pin protruding downwardly and engageable with each said pin hole of each said lower stem for combining the upper half shell with the lower half shell for assembling the switch housing, a button socket formed in the upper half shell for embedding the push-button switching means in the button socket, a button hole formed in a central portion of the upper half shell for protruding the push button of the switching means upwardly and outwardly from the housing, and a pair of upper semi-holes respectively formed in two opposite end portions of the upper shell, each upper semi-hole having a plurality of corrugated teeth formed therein, said pair of upper semi-holes being combinable with the pair of lower semi-holes of the lower shell, said pairs being adapted for respectively clamping the input cord and the output cord in the semi-holes to have the cords bitten by the corrugated teeth formed in the semi-holes for firmly securing the input and output cords to the switch housing; and said push-button switching means including: the push button reciprocatively held in a button holder engageably embedded in the button socket in the housing and retained on the central protrusion of the lower shell with the push button normally protruding upwardly outwardly from the button hole of the housing to be operatively depressed for switching on or off power supply through the input cord and the output cord of the power source.

2. An on-line switch according to claim 1, wherein said protective cover includes two cord sheaths, and each of said cord sheath having a lug protruding sideways from the sheath and formed with a hanging hole in the lug for hanging said switch on an object.

3. An on-line switch according to claim 1, wherein said sealing cap is made of electrically insulative elastomer materials and includes: a sleeve member having a plurality of female threads formed in the sleeve member and engageable with a plurality of male threads formed on the button holder of the switching means, a bellows portion having a plurality of corrugated concentric rings overlapping with one another and telescopically expandible and retractable about a longitudinal axis of the cap, an upper cap portion formed on a top portion of the bellows portion for operatively depressing the push button of the switching means disposed within the cap, and a packing ring packed between the cap and a base portion of the switching means for sealably securing the cap on the switching means.

* * * * *